United States Patent [19]

Ginpil et al.

[11] Patent Number: 4,547,918

[45] Date of Patent: Oct. 22, 1985

[54] BODY SUPPORTING NETWORK

[75] Inventors: Frederick D. Ginpil, Toronto; Morris Milner, Willowdale; John W. Senders, Toronto, all of Canada

[73] Assignee: Ontario Crippled Children's Centre, Toronto, Canada

[21] Appl. No.: 523,777

[22] Filed: Aug. 16, 1983

[51] Int. Cl.[4] ..... A61G 7/00; A47C 3/00

[52] U.S. Cl. ..... 5/446; 5/190; 5/431; 267/89; 267/112; 297/284

[58] Field of Search ..... 5/190, 188, 189, 191, 5/199, 446, 447, 431; 297/284; 267/89, 112

[56] References Cited

U.S. PATENT DOCUMENTS

| | | | |
|---|---|---|---|
| 20,750 | 6/1858 | Warner | 5/190 |
| 21,519 | 9/1858 | Russell | 5/190 |
| 23,064 | 2/1859 | Morse | 5/190 |
| 29,540 | 8/1860 | Buxton | 5/190 |
| 229,085 | 6/1880 | Boyers | 5/190 |
| 465,024 | 12/1891 | Kraber | 5/190 |
| 852,776 | 5/1907 | Druding | 5/191 |
| 1,987,921 | 1/1935 | Bertsch | 5/191 |
| 4,367,897 | 1/1983 | Cousins | 297/284 |

*Primary Examiner*—Alexander Grosz

*Attorney, Agent, or Firm*—Cushman, Darby & Cushman

[57] ABSTRACT

The present invention relates to a body supporting network suitable for use with a load supporting system. The network includes at least first and second pluralities of elongate support members securable with the system for supporting a load. The first and second support members respectively extend in first and second directions to provide potential load receiving intersections where the first support members cross the second support members. The network includes adjustment means to vary network pressure response at each intersection and to permit changes in network contour. The network includes interconnecting means for connecting the elongate members at the intersections to maintain network integrity when the network is subjected to the load.

20 Claims, 6 Drawing Figures

FIG.3.
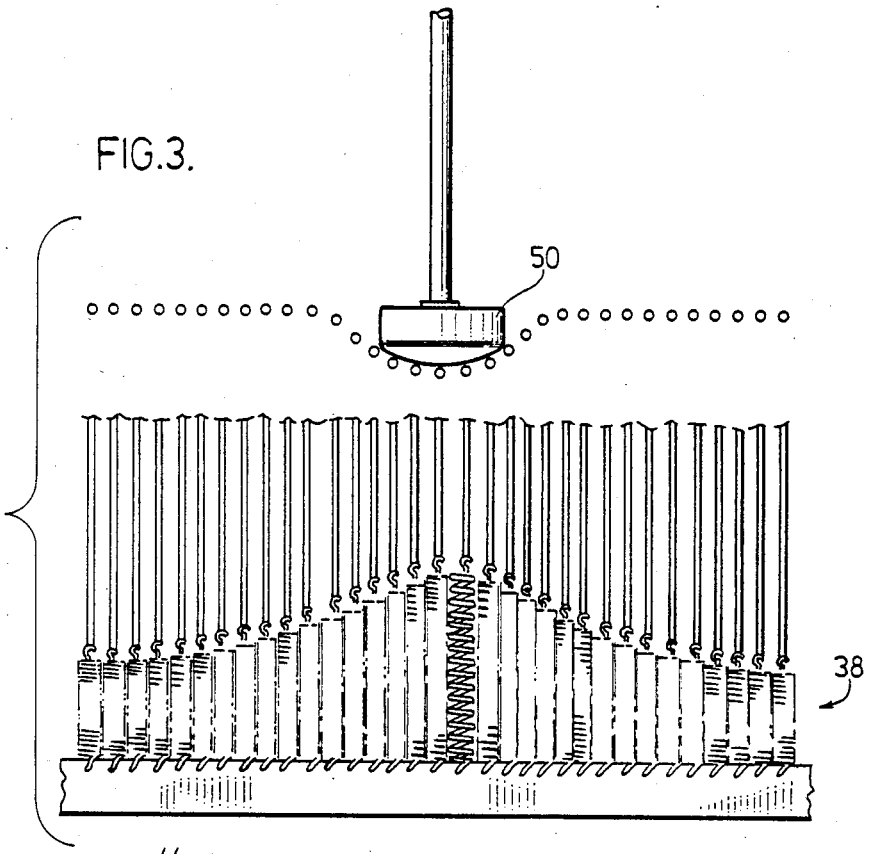
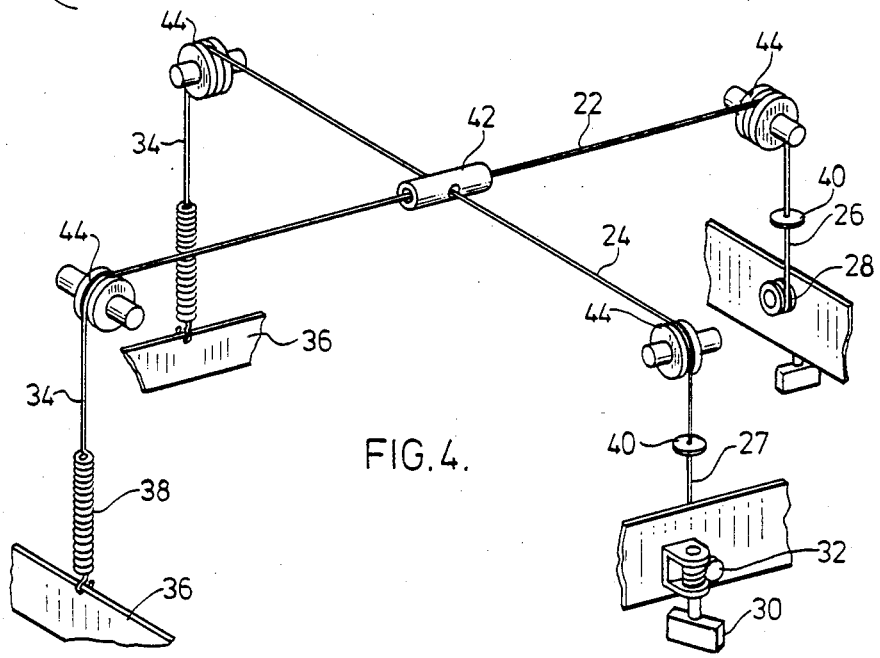
FIG. 4.

BODY SUPPORTING NETWORK

The present invention relates to a body supporting network suitable for use with a load supporting system. In particular, the present invention relates to a body supporting network suitable for use with furniture.

The term "furniture" is to be construed as including motor vehicle seating, household seating, beds of all kinds, back rests, special seating for the disabled such as, for example, wheel chairs, and also train seating, aircraft seating and the like. The term "body supporting network" is to be construed as meaning a web or mesh attached to the framework of the load supporting system to support a load. Furthermore, upholstery or a cushion may cover or form part of the body supporting network. The body may be inanimate.

Good body supporting furniture is required by most individuals. In particular, body supporting furniture is required to accommodate individuals with physical deformities and/or neuro-muscular disorders to provide comfortable and functional furniture. Also, invalids or disabled individuals whose movement is restricted or limited for extended periods of time require specially adapted body supporting furniture; otherwise, continued localized loading of the tissues of the individual can result in pressure sores.

Present body supporting seating systems tend to support an individual with foam or plastic materials and, for patients having physical deformities or disorders, the seats are shaped or fitted to each individual. It is also known to use pressure distribution cushions as postural supports which cushions usually house a fluid and conform to a specific shape.

With furniture such as beds, it is known to attach elongated spring-like members or strips of material to the frame structure of the bed by means of springs and extendable bolts. The springs allow for relative movement between the frame and elongate members and the bolts are provided to draw the springs and elongate members taut. The elongate members are either interleaved or placed one above the other to form a grid pattern. When the members are interleaved movement between elongate members to adjust tension is difficult. When the members are not interleaved but rather arranged one above the other, network integrity during loading is difficult to maintain. In any event, the purpose of the bed springs is to maintain a surface having a relatively flat contour.

Such beds and postural seating cannot accommodate changes in the loading configuration and, in many instances, modifications in the posture. As a result, any seating specifically developed for a particular individual cannot be readily altered to accommodate other individuals, is expensive and is limited in function.

It is a primary object of the present invention to provide a body supporting network for a load supporting system which maintains network integrity and permits changes in network pressure response and network contour.

It is another object of the present invention to provide a body supporting network that provides exoskeletal control of an individual.

It is another object of the present invention to provide a body supporting network which can be used for a variety of functions by different individuals thereby minimizing the need for individualized construction or the combined use of two or more systems.

It is another object of the present invention to provide a body supporting network which may be economically manufactured.

It is another object of the present invention to provide a body supporting network for furniture that may be used in the rehabilitation of patients.

The present invention provides a body supporting network suitable for use with a load supporting system. The network includes at least first and second pluralities of elongate support members securable with the system for supporting a load. The first and second support members respectively extend in first directions and second directions to provide potential load receiving intersections where the first support members cross second support members. The network includes adjustment means for varying network pressure response at the load intersections and for permitting changes in network contour. The network includes interconnecting means for connecting the elongate members at the intersections to maintain network integrity when the network is subjected to the load.

Advantage is found with the present invention in that network pressure response and network contour can be varied. Accordingly, the body supporting network can be adjusted to accommodate its pressure response to different loads or various load conditions of the same load. The contour or shape of the network can be adjusted such that the network contour conforms to a desired body shape or an actual body shape when the network is subjected to the load. Furthermore, the interconnecting means maintains network integrity when the network is subjected to the load. This latter feature ensures that desired network pressure response and network contour to the load is maintained.

It is also envisaged that the interconnecting means may be adapted to receive one elongate support member of each of the pluralities of elongate support members such that the one elongate support members are moveable relative to each other and the interconnecting means. Further, the interconnecting means may surround each of the one elongate support members to preclude direct contact between the load and elongate support members at the intersections. By providing relative movement between the elongate members within the interconnecting means, the network contour and network pressure response can be altered when the network is subjected to the load. Furthermore, by having the interconnecting means surround the elongate members, it is easier to adjust the lengths of the elongate members and thereby alter network pressure response and network contour.

In the preferred construction the support members consist of first and second pluralities of support members extending in first substantially parallel directions and second substantially parallel directions, respectively. These directions are orthogonal so as to define a grid structure. The interconnecting means preferably comprise cylinders each having axial and diametrical passages therethrough. The cylinders are hollow, are located at each of the intersections and are arranged in a predetermined pattern. The pattern is such that the longitudinal axis of each cylinder extends substantially at right angles to the longitudinal axes of cylinders adjacent said cylinder. The adjustment means comprise rotatable spool means about which end portions of the support means are wrapped. Measuring means in the form of spring means are attached to the other end portions of the support means and provide a measurement of network pressure response. Each support member includes one spring means and one rotatable spool means. The elongate support members, each comprise a length of string. The springs are located adjacent each other such that the string pressures can be readily monitored on a graph. On the other side of the furniture a locating marker or member is provided adjacent each of the first end portions to indicate the amount the string has been lengthened.

The employment of the interconnecting cylinders allows the lengths of each of the elongate members or strings to be controlled when the network is subjected to the load. This makes it feasible to adjust the network contour and network pressure response and thereby adapt the network to accommodate a variety of disabilities and/or functions. This is of particular advantage for individuals who wish to use the network for more than one function, or for growth adjustments in children. Accordingly, the network has potential for continuous variable exoskeletal control and network pressure response to loading. As a consequence of the network being adaptable to individual requirements, the network can be economically manufactured.

By lengthening the strings, the pressure response of each string and at each load intersection experienced by specific areas of the body is reduced. Accordingly, the network can be used for rehabilitation purposes, such as, for example, preventing and/or rehabilitating pressure sores.

By providing the interconnecting cylinders, each of the strings or elongate members are free to move relative to each other because each cylinder contacts the load thereby reducing the friction on the strings or elongate members. Further, the cylinders or interconnecting means act to maintain the load receiving intersection where the strings cross. This maintains network integrity. The interleaved spatial arrangement of the cylinders facilitates the overall performance of the network or mesh by ensuring the free movement and consistent spacing of the strings or elongate members passing from the adjustment spools to the springs. It should be understood that instead of cylinders, spheres may be used, however, cylinders may be more practical from a manufacturing standpoint.

For a better understanding of the nature and objects of the present invention reference may be had by way of example to the accompanying diagrammatic drawings in which:

FIG. 3 is a schematic view which graphically illustrates the manner in which the network may be loaded;

FIG. 4 is a perspective view showing the connections of two strings to the furniture;

Figure 1:
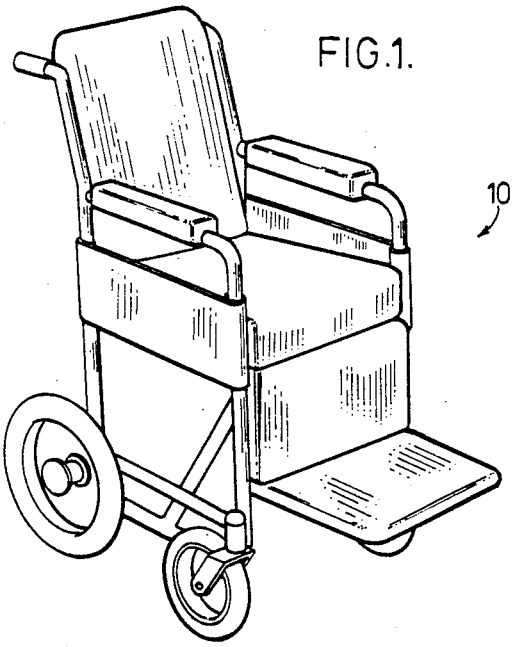
FIG. 1 is a general view showing a wheel-chair in which the body supporting network of the present invention may be used.

Referring to FIG. 1 there is shown a wheel-chair generally at 10. While the present invention may be used in various types of furniture, it should be understood that the present invention has been developed for incorporation in a wheel-chair. The body support network of the present invention is preferably included in the seat portion of the wheel chair.

Figure 2:
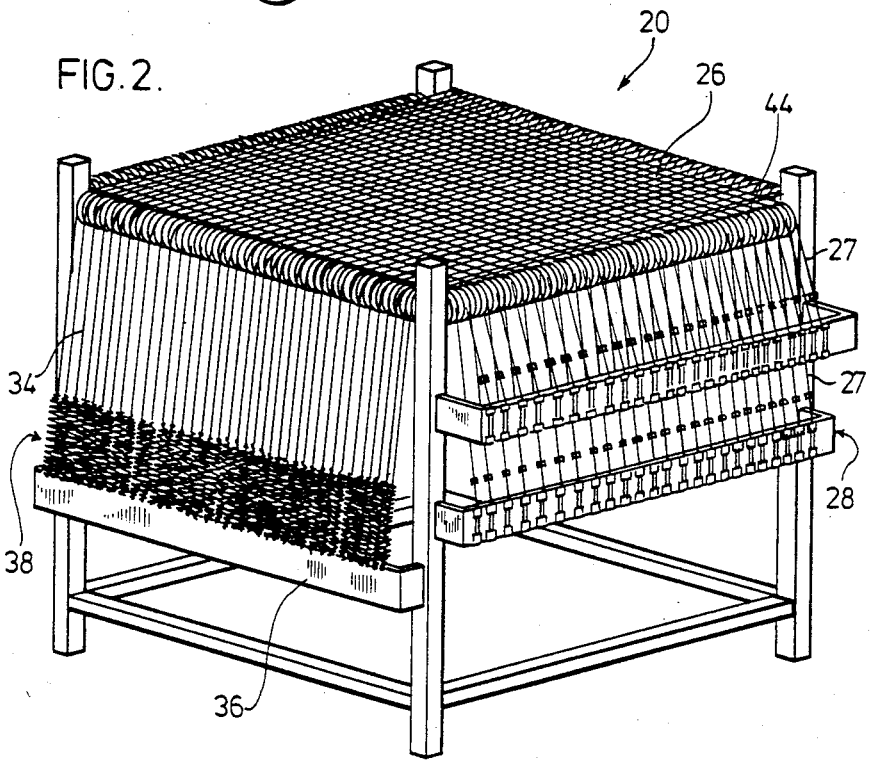
FIG. 2 is a general perspective view showing the attachment of a body supporting network to furniture.

Referring to FIGS. 2 through 5 inclusive, the preferred embodiment of the present invention is described. A body supporting network is shown generally at 20. The network includes a first plurality of elongate support members 22 and a second plurality of elongate support members 24. The support members 22 and 24 preferably comprise nylon string. Support members 22 extend in first generally parallel directions and support members 24 extend in second generally parallel directions. The first members 22 and second members 24 extend orthogonally to each other and provide potential load receiving intersections 26 where they cross. The first end portions 27 of members 22 and 24 are attached to the furniture frame by adjustment means comprising spool means 28, around which the first end portion 27 of the string is attached. Each spool means 28 includes a thumb screw 30 and a holding washer 32. The other washer 32 prevents the rotation of the spool means 28. The second end portions 34 of the strings 22 and 24 are attached to the frame 36 of the furniture or wheel chair by spring means 38. The springs 38 are aligned adjacent each other along one side of the furniture as shown in FIGS. 2 and 3. The end portions 26 of strings 22 and 24 include a locating member or washer 40. The function of the adjustment means or spool means 28 and the function of the spring means 38 is later described.

An interconnecting means 42 is located at the intersection of each of the members 22 and 24. The interconnecting means 42 is adapted to receive therethrough one member of each of the string members 22 and 24. The one members extending through the interconnecting means 42 are movable therethrough so as to vary the network pressure response at the intersecting means 42 to a load supported by the network 20. As shown in the drawings, an interconnecting means 42 is provided at each of the intersections. It should be understood that in instances where the load may be centralized, it may not be necessary to provide an interconnecting means at each of the intersections of members 22 and 24. Accordingly, it is only necessary for an intersecting means 42 to be provided at load receiving intersections. It should also be understood that in FIG. 2, the interconnecting means 42 are not shown. The interconnecting means 42 are not shown simply for the purposes of clarity. FIG. 2 shows the grid-like network established by the strings 22 and 24.

Referring to FIGS. 2 and 4, guide pulleys 44 are provided at the upper edges of the frame structure. It should be understood that the purpose of the guide pulley is to orientate the strings 22 and 24 and provide a surface over which the direction of the strings may be altered.

Figure 5:
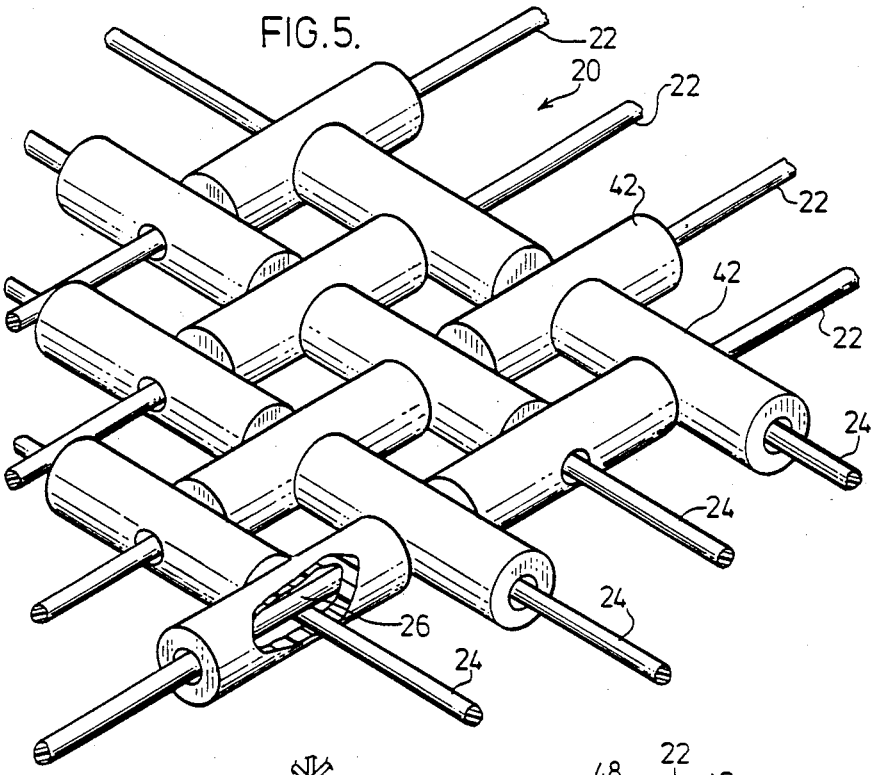
FIG. 5 is a three-dimensional view showing the pattern of the cylinders of the network and the manner in which the load receiving intersections are held relative to one another by cylinders.

In FIGS. 4 and 5, the preferred construction of the interconnecting means 42 is shown to comprise a hollow cylinder 42 having axial and diametrical passages extending therethrough.

Referring particularly to FIG. 5, there is shown a predetermined pattern or arrangement of the cylindrical interconnecting members 42. The cylindrical members 42 are arranged in an interleaved fashion wherein the longitudinal axis of each cylinder extends substantially at right angles to the longitudinal axis of cylinders adjacent the said each cylinder.

Figure 6:
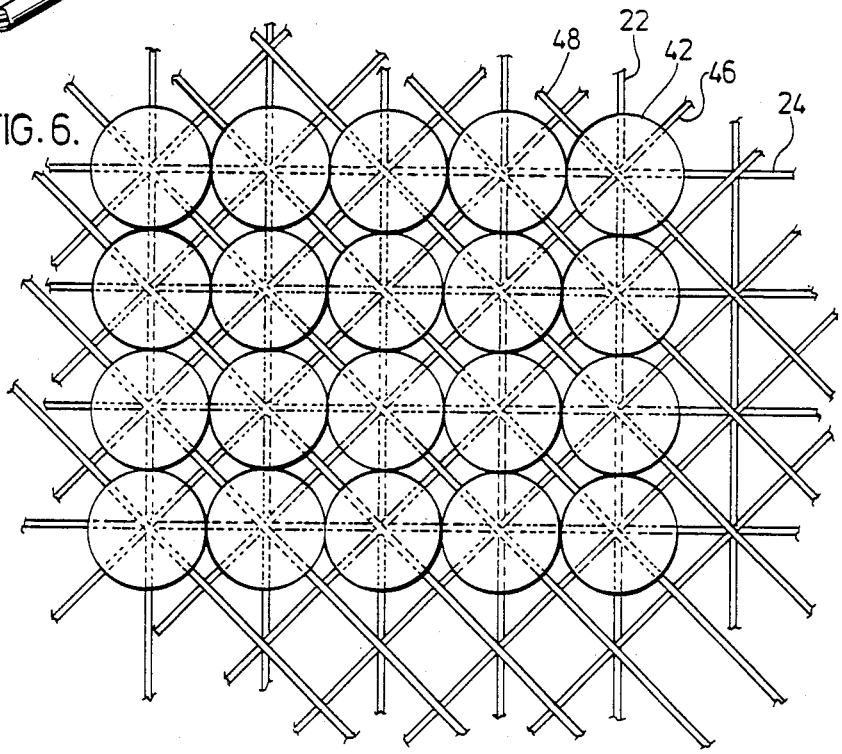
FIG. 6 is a plan view of an alternate embodiment showing a plurality of groups of strings which extend through spherical members.

In FIG. 6 there is shown an alternate embodiment wherein the interconnecting means 42 comprise spheres. This drawing illustrates that more than two sets of substantially parallel groups of elongate members may be employed. For example, in this network there are four sets of substantially parallel string members respectively numbered 22, 24, 46 and 48. The point at which these strings cross comprises the load receiving intersection which is surrounded by a sphere. The sphere will be provided with the appropriate number of apertures to allow the passage of the strings therethrough. It should be understood that other load receiving shapes may be employed for the interconnecting member. The primary purpose of the interconnecting means is to maintain the integrity of the mesh or grid relationship of the network. In the preferred embodiment the secondary purpose of the interconnecting means is to ensure that there is no direct connection between the load and the strings whereby the friction of the strings with respect to the load is reduced permitting easier relative movement of the strings.

For a better understanding of the operation of the present invention, reference may be had to FIGS. 3 and 4. When the network is subjected to a load, as indicated by load 50 in FIG. 3, certain strings of the elongated members will receive the load at intersecting points thereon. By adjusting the thumb screws 30 of the adjustment means or spool means 28, the network pressure response can be varied such that the strings take on a predetermined contour when subjected to the load. Thus, by adjusting the length of the strings 22 and 24, the network pressure response to the load at each intersection may be altered. The washers 40 on the end portions 26 of strings 22 and 24 will indicate the amount of string that has been loosened relative to the strings adjacent thereto. The interconnecting cylinders permit the strings to be moved when subjected to the load and maintain the integrity of the network. As a result, the pressure response to the network may be controlled to vary the pressure felt by the individual sitting, lying or resting on the furniture and to vary the contour of the network allowing the individual to alter his position.

The purpose of the springs is to provide a measurement of string tension when the network is subjected to a load. This measurement is representative of network pressure response to a load and can be used to advantage to eleviate uncomfortable positions or pressure sores.

It should be understood that the springs 38 and spool means 28 do not necessarily have to be on the same side of the furniture and may be located beneath the furniture simply by extending the length of the string or elongate support members and providing additional frictional pulleys.

It should be understood that the subject invention may be readily adapted to a computer such as a microprocessor where individual programs can be programmed into the microprocessor and interfaced with the adjustment means such that network pressure response to predetermined loads at the load receiving intersections and interconnecting means can be varied in accordance with a predetermined schedule. Such a system can be responsive to feedback from measurements taken for the length of the strings in the network and the amount of tension experienced by each spring means when subjected to the load.

It should be understood that other means for measuring string tension and network pressure response other than springs can be employed. One example of an alternative measuring device is a strain gauge.

While the interconnecting means shown in the preferred embodiments comprises a member which encloses the elongate support members it should be understood that a releasable fastening interconnecting means may be employed which does not necessarily surround the elongate support members or permit relative movement of the elongate support members.

It should also be understood that means for registering lengths of string released from the adjustment means other than locating member or washer 40 may be employed.

The embodiments of the invention in which an exclusive property or privilege is claimed are defined as follows:

1. A body-supporting network suitable for use with a load supporting frame, said network comprising:

at least first and second pluralities of elongate support members each connected to said frame for supporting a load, the first and second support members respectively extending in first directions and second directions to provide potential load receiving intersections responsive to said load where the first support members cross the second support members;

adjustment means for controlling network pressure response at said load receiving intersections and for permitting changes in network contour of said first and second pluralities of elongate members; and interconnecting means for connecting said elongate members at said intersections to maintain network integrity when the network is subjected to said load.

2. A network according to claim 1 wherein the network pressure response of each elongate member is adjustable to vary network pressure response to loading at each intersection.

3. A network according to claim 2 wherein said network pressure response is varied by varying the length of one or more of said elongate members.

4. A network according to claim 1 wherein said first directions are substantially parallel and said second directions are substantially parallel.

5. A network according to claim 4 wherein the first substantially parallel directions are orthogonal to the second substantially parallel directions.

6. A network according to claim 1 wherein said interconnecting means is adapted to receive one member of each of the pluralities of elongate support members, said one elongate support means being movable relative to said interconnecting means to permit changes in the network contour when subjected to said load.

7. A network according to claim 6 wherein said interconnecting means surrounds said one elongate members.

8. A network according to claim 7 wherein said interconnecting means comprises a cylinder having axial and diametrical passages therethrough.

9. A network according to claim 8 wherein the cylinder is hollow.

10. A network according to claim 8 wherein the cylinders are located at each of the intersections and are arranged in a predetermined pattern.

11. A network according to claim 10 wherein the longitudinal axis of each cylinder extends substantially at right angles to the longitudinal axes of cylinders adjacent said each cylinder.

12. A network according to claim 1 further including means for measuring network pressure response to load.

13. A network according to claim 12 wherein said measuring means includes spring means attached to first end portions of the support means.

14. A network according to claim 13 wherein said adjustment means comprise a rotatable spool means about which second end portions of said support means are wrapped.

15. A network according to claim 14 wherein each support member includes one spring means and one rotatable spool means.

16. A network according to claim 15 wherein the spring means of each of the support members of each of the first and second pluralities of support members are located adjacent each other whereby the spring extension of each spring means can be readily monitored, and the spool means are rotatable to increase the length of the elongate members thereby increasing the surface in contact with the load and reduce the network pressure response to the load.

17. A network according to claim 14 wherein each elongate member includes a locating member adjacent the second end portion indicative of the relative length of elongate member forming part of the network.

18. A network according to claim 1 wherein said load supporting system is furniture and said network is postural-supporting.

19. A network according to claim 1 wherein said elongate support members each comprise a length of string.

20. A network according to claim 1 further including means for registering the length each of the elongate members released from said adjustment means.

* * * * *